US009920256B2

(12) United States Patent
Tanaka et al.

(10) Patent No.: US 9,920,256 B2
(45) Date of Patent: Mar. 20, 2018

(54) HYDROCARBON COMPOUND DISTILLATION SEPARATION APPARATUS

(71) Applicants: Japan Oil, Gas and Metals National Corporation, Tokyo (JP); INPEX Corporation, Tokyo (JP); JX Nippon Oil & Energy Corporation, Tokyo (JP); Japan Petroleum Exploration Co., Ltd., Tokyo (JP); Cosmo Oil Co., Ltd., Tokyo (JP); Nippon Steel & Sumikin Engineering Co., Ltd., Tokyo (JP)

(72) Inventors: Yuichi Tanaka, Tokyo (JP); Yasumasa Morita, Tokyo (JP); Kenichi Kawazuishi, Yokohama (JP)

(73) Assignees: JAPAN OIL, GAS AND METALS NATIONAL CORPORATION, Tokyo (JP); INPEX CORPORATION, Tokyo (JP); JX NIPPON OIL & ENERGY CORPORATION, Tokyo (JP); JAPAN PETROLEUM EXPLORATION CO., LTD., Tokyo (JP); COSMO OIL CO., LTD., Tokyo (JP); NIPPON STEEL ENGINEERING CO., LTD., Tokyo (JP)

( * ) Notice: Subject to any disclaimer, the term of this patent is extended or adjusted under 35 U.S.C. 154(b) by 81 days.

(21) Appl. No.: 14/615,705

(22) Filed: Feb. 6, 2015

(65) Prior Publication Data

US 2015/0191658 A1 Jul. 9, 2015

Related U.S. Application Data

(62) Division of application No. 13/138,482, filed as application No. PCT/JP2010/001320 on Feb. 26, 2010, now Pat. No. 8,974,660.

(30) Foreign Application Priority Data

Feb. 27, 2009 (JP) ..... 2009-046152

(51) Int. Cl.
*C10G 7/00* (2006.01)
*C10G 2/00* (2006.01)
(Continued)

(52) U.S. Cl.
CPC ..... *C10G 7/00* (2013.01); *C10G 2/32* (2013.01); *C10G 53/16* (2013.01);
(Continued)

(58) Field of Classification Search
CPC ..... C10G 2300/1022; C10G 2400/02; C10G 2400/06; C10G 2400/08; C10G 2/32; C10G 53/16; C10G 7/00
See application file for complete search history.

(56) References Cited

U.S. PATENT DOCUMENTS 6,656,343 B2 12/2003 Dancuart
2003/0158456 A1 8/2003 O'Rear et al.

FOREIGN PATENT DOCUMENTS

AU 2007239819 * 3/2007 ..... C10G 2/00
AU 2007239819 10/2007
(Continued)

OTHER PUBLICATIONS

Perry's Chemical Engineer's Handbook, 2008, McGraw-Hill, 8th Ed., pp. 13-4-13-67.*
(Continued)

*Primary Examiner* — Renee Robinson
*Assistant Examiner* — Derek N Mueller
(74) *Attorney, Agent, or Firm* — Andrews Kurth Kenyon LLP

(57) ABSTRACT

There is provided a hydrocarbon distillation separation apparatus for fractionally distilling hydrocarbon compounds
(Continued)

discharged from a Fisher-Tropsch synthesis reactor synthesizing hydrocarbon compounds, comprising a heavy hydrocarbon fractionator configured to fractionally distil liquid heavy components of the hydrocarbon compounds discharged from the reactor into a first middle distillate and a wax fraction, a light hydrocarbon fractionator configured to fractionally distil gaseous light components of the hydrocarbon compounds discharged from the reactor into a second middle distillate and a light gas fraction, a light hydrocarbon separator configured to separate hydrocarbon compounds equivalent to naphtha from the light gas fraction; and a mixing section configured to mix the first and second middle distillates, and the hydrocarbon compounds equivalent to naphtha separated from the light gas fraction by the light hydrocarbon separator.

2 Claims, 3 Drawing Sheets

(51) Int. Cl.
*C10G 45/00* (2006.01)
*C10G 53/16* (2006.01)

(52) U.S. Cl.
CPC . *C10G 2300/1022* (2013.01); *C10G 2400/02* (2013.01); *C10G 2400/06* (2013.01); *C10G 2400/08* (2013.01)

(56) References Cited

FOREIGN PATENT DOCUMENTS

| | | |
|---|---|---|
| CN | 1594507 | 3/2005 |
| CN | 1699520 | 11/2005 |
| CN | 1814703 | 8/2006 |
| GB | 2398793 | 9/2004 |
| JP | 2004-323626 | 11/2004 |
| WO | WO2007/114279 | 10/2007 |
| WO | WO2007/119587 | 10/2007 |

OTHER PUBLICATIONS

Office Action dated May 6, 2014 issued in Gulf Cooperation Council Patent Application No. 2010-15336.
Examination Report dated May 8, 2014 issued in Gulf Cooperation Council Patent Application No. 2010-15336.
Chinese Office Action dated May 21, 2013, issued in corresponding Chinese Application No. 201080008912.3, with a partial English translation of the Search Report only.
Perry's Chemical Engineers' Handbook, 2008, McGraw-Hill, 8th ed, pp. 13-4-13-5.
European Search Report dated Aug. 1, 2012, issued in corresponding European Application No. 10746010.7.
International Search Report dated Mar. 23, 2010 issued in corresponding PCT Application No. PCT/JP2010/001320.

* cited by examiner

[FIG. 1]
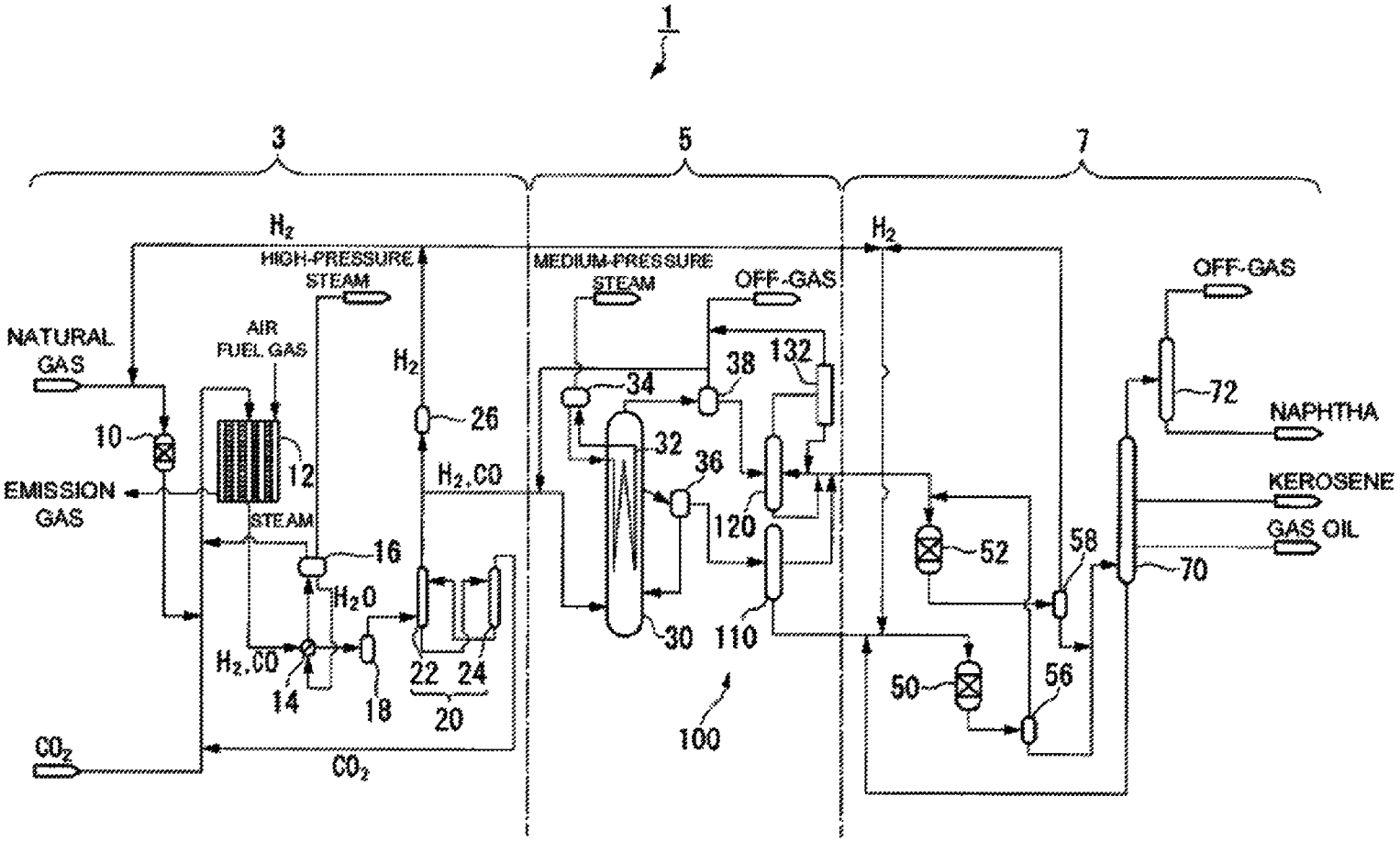

[FIG. 2]
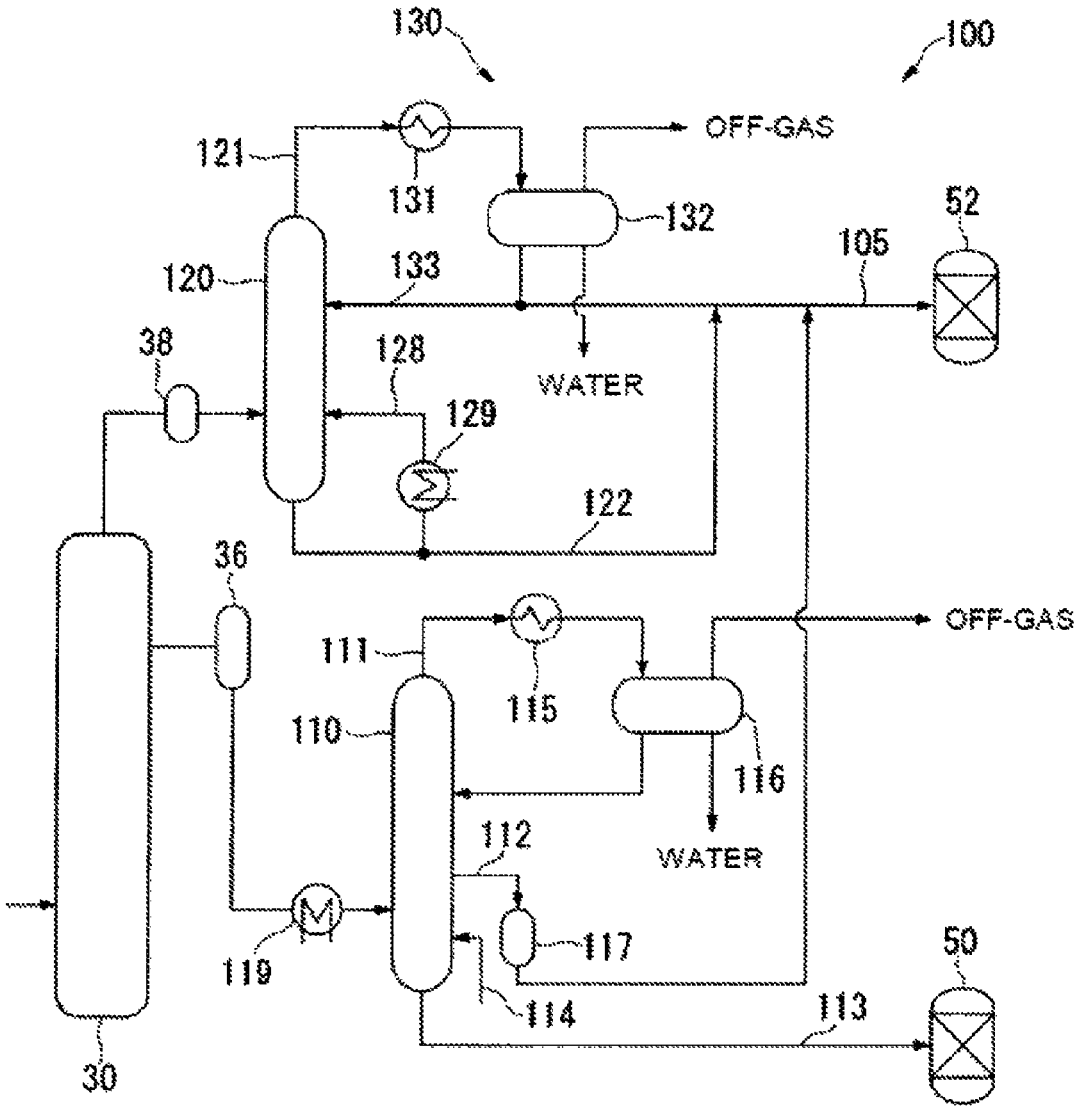

[FIG. 3]
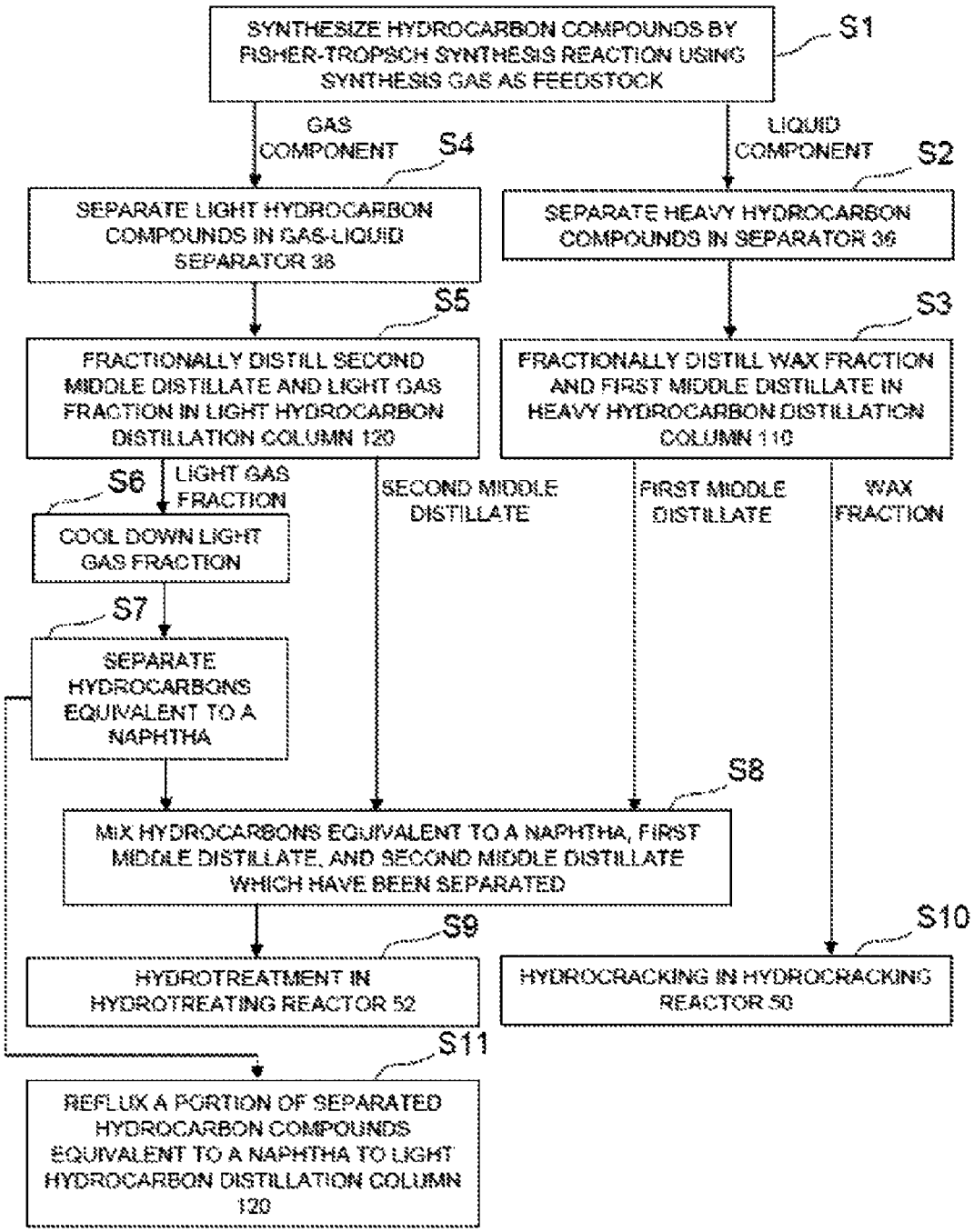

HYDROCARBON COMPOUND DISTILLATION SEPARATION APPARATUS

CROSS-REFERENCE TO RELATED APPLICATION

This application is a divisional application of U.S. application Ser. No. 13/138,482, filed Aug. 24, 2011, which is a national stage application of International Application No. PCT/JP2010/001320, filed Feb. 26, 2010, which claims priority to Japanese Application No. 2009-046152, filed Feb. 27, 2009, each of which is incorporated by reference in its entirety.

TECHNICAL FIELD

The present invention relates to method for upgrading hydrocarbon compounds and hydrocarbon compound distillation separation apparatus which separate and refine hydrocarbon compounds synthesized by a Fisher-Tropsch synthesis reaction.

BACKGROUND ART

As one of the methods for synthesizing liquid fuels from a natural gas, a GTL (Gas To Liquids: a liquid fuel synthesis) technique has recently been developed. In the GTL technique, a natural gas is reformed to synthesize a synthesis gas containing a carbon monoxide gas (CO) and a hydrogen gas ($H_2$) as main components, and then, hydrocarbon compounds are synthesized by the Fischer-Tropsch synthesis reaction using the synthesis gas as a feedstock gas. Further, in the GTL technique, the hydrocarbon compounds are hydrogenated and fractionally distilled to produce liquid fuel products, such as a naphtha (raw gasoline), a kerosene, a gas oil, and a wax.

Since the liquid fuel products from the hydrocarbon compounds used as a feedstock have high paraffin content, and include no sulfur components, for example, as shown in Patent Document 1, the liquid fuel products attract attention as environment-friendly fuels.

In a synthesis reactor which performs the Fisher-Tropsch synthesis reaction, heavy hydrocarbon compounds with a comparatively high number of carbon atoms are produced as a liquid, and light hydrocarbon compounds with a comparatively low number of carbon atoms (mainly including hydrocarbons equivalent to naphtha) are generated as a gas.

As an example of a method for obtaining liquid-fuel products from the light and heavy hydrocarbon compounds, the following process is mentioned. First, the light hydrocarbon compounds discharged as a gas from the synthesis reactor are cooled down and liquefied by a heat exchanger. And the liquefied light hydrocarbon compounds are separated and recovered in a gas-liquid separator. Then, the recovered light hydrocarbon compounds are mixed with the heavy hydrocarbon compounds discharged as a liquid from the synthesis reactor, and are brought to a fractionator.

Then, the hydrocarbon compounds are fractionally distilled according to boiling points in the fractionator, and are fractionally distilled into a naphtha fraction (the boiling point of which is lower than about 150° C.), a middle distillate equivalent to a kerosene and a gas oil (the boiling point of which is about 150 to 360° C.), and a wax fraction (the boiling point of which is higher than about 360° C.).

The naphtha fraction, the middle distillate, and the wax fraction are hydrotreated respectively to produce liquid fuels and other products, such as a naphtha, a kerosene, a gas oil, or a wax.

CITATION LIST

Patent Document

[Patent Document 1] Japanese Patent Unexamined Publication No. 2004-323626

SUMMARY OF INVENTION

Technical Problem

In the above method described as an example, the heavy hydrocarbon compounds discharged as a liquid from the synthesis reactor, and the light hydrocarbon compounds recovered from a gas component discharged from the synthesis reactor are mixed together, and are then fractionally distilled in the fractionator, as stated above.

When a mixture of the light and heavy hydrocarbon compounds is fractionally distilled into a naphtha fraction, a middle distillate, and a wax fraction in the fractionator, there is a problem in that the light hydrocarbon compounds mainly including the naphtha fraction are subjected to excessive heating exceeding that essentially required for the fractional distillation thereof. As a result, the energy cost required for the distillation may increase.

The present invention was made in view of the aforementioned circumstances, and an object thereof is to provide a method for upgrading hydrocarbon compounds and a hydrocarbon compound distillation separation apparatus capable of efficiently recovering hydrocarbons equivalent to naphtha from hydrocarbon compounds synthesized in a Fisher-Tropsch synthesis reaction, and reducing the energy cost for separating a naphtha fraction, a middle distillate, and a wax fraction from the hydrocarbon compounds synthesized in a Fisher-Tropsch synthesis reaction.

Solution to Problem

In order to solve the above problem and achieve such an object, the present invention suggests the following methods and apparatuses.

That is, a method for upgrading hydrocarbon compounds, in which hydrocarbon compounds synthesized in a Fisher-Tropsch synthesis reaction are fractionally distillated, and the fractionally distillated hydrocarbon compounds are hydrotreated to produce liquid fuel products.

The method includes fractionally distilling heavy hydrocarbon compounds synthesized in the Fisher-Tropsch synthesis reaction as a liquid into a first middle distillate and a wax fraction, and fractionally distilling light hydrocarbon compounds synthesized in the Fisher-Tropsch synthesis reaction as a gas into a second middle distillate and a light gas fraction.

In the method for upgrading hydrocarbon compounds of the present invention, fractional distillation of the heavy hydrocarbon compounds and fractional distillation of the light hydrocarbon compounds are separately performed. Thus, the fractional distillation of the light hydrocarbon compounds can be conducted by minimum necessary heating, and can reduce the energy for heating the light hydrocarbon compounds. Accordingly, the energy required for fractional distillation of the hydrocarbon compounds is reduced by the present invention.

In addition, although the hydrocarbon compounds equivalent to naphtha are contained even in the heavy hydrocarbon compounds, since the content thereof is very small, there is no great influence on the naphtha production. Additionally, in the fractional distillation of the light hydrocarbon compounds, the light hydrocarbon compounds including a lot of hydrocarbon compounds equivalent to naphtha are fractionally distilled into the light gas fraction and the second middle distillate. Thus, the hydrocarbons equivalent to naphtha can be efficiently recovered.

The method for upgrading hydrocarbon compounds may further includes separating hydrocarbon compounds equivalent to naphtha from the light gas fraction.

In this case, it is possible to separate the hydrocarbons equivalent to naphtha which exist in the light gas fraction.

The method for upgrading hydrocarbon compounds may further includes refluxing a part of the hydrocarbon compounds equivalent to naphtha to the step of fractionally distilling the light hydrocarbon compounds.

The method for upgrading hydrocarbon compounds may further includes mixing the hydrocarbon compounds equivalent to naphtha, the first middle distillate, and the second middle distillate, and hydrotreating the mixture thereof.

A mixture of the hydrocarbon compounds equivalent to naphtha, the first middle distillate, and the second middle distillate is including hydrocarbon compounds equivalent to naphtha ($C_5$ to $C_{10}$), hydrocarbon compounds equivalent to kerosene ($C_{11}$ to $C_{15}$), and hydrocarbon compounds equivalent to gas oil ($C_{16}$ to $C_{20}$). These hydrocarbon compounds can be hydrotreated under the same conditions. Hence, the cos required for the hydrotreating can be reduced when the hydrotreating is performed after the hydrocarbon compounds equivalent to naphtha, the first middle distillate, and the second middle distillate are mixed together.

In the separation of the hydrocarbon compounds equivalent to naphtha, the pressure of the light gas fraction to separate the light gas fraction and the hydrocarbon compounds equivalent to naphtha may be set to a value within a range of 200 to 600 kPa.

In this case, since the pressure of the light gas fraction is set to 600 kPa or less, the moisture in the light gas fraction can be prevented from condensing. Meanwhile, since the pressure of the light gas fraction is set to 200 kPa or more, the content of the hydrocarbon compounds equivalent to naphtha included in the light gas fraction after the separation thereof can be suppressed to be small.

In the fractional distillation of the light hydrocarbon compounds, the temperature of the light gas fraction may be set to a value within a range of 100 to 120° C.

In this case, since the temperature of the light gas fraction is set to 100° C. or higher, the moisture in the light gas fraction can be prevented from condensing. Additionally, since the temperature of the light gas fraction is set to 120° C. or lower, heat duty in the fractional distillation of the light hydrocarbon compounds can be suppressed, and the energy cost can be reduced.

In the fractional distillation of the light hydrocarbon compounds, the temperature of the second middle distillate may be set to a value within a range of 250 to 270° C.

In this case, since the temperature of the second middle distillate is set to 270° C. or lower, the heat duty in the fractional distillation of the light hydrocarbon compound can be suppressed, and the energy cost can be reduced. Additionally, it is also possible to utilize a high-pressure steam having temperature range of 260 to 300° C. as a heat source for heating. Meanwhile, since the temperature of the bottom of the fractionator distilling the light hydrocarbon compounds is set to 250° C. or higher, the second middle distillate and the light gas fraction can be fractionally distilled efficiently.

The hydrocarbon compound distillation separation apparatus according to the present invention is an apparatus for fractionally distilling hydrocarbon compounds discharged from a synthesis reactor producing hydrocarbon compounds using a Fisher-Tropsch synthesis reaction.

The apparatus includes a heavy hydrocarbon fractionator for fractionally distilling heavy hydrocarbon compounds discharged from the synthesis reactor into a first middle distillate and a wax fraction, and a light hydrocarbon fractionator for fractionally distilling light hydrocarbon compounds discharged from the synthesis reactor into a light gas fraction and a second middle distillate.

In the hydrocarbon compounds distillation separation apparatus of the present invention, the apparatus includes the heavy hydrocarbon fractionator which fractionally distills the heavy hydrocarbon compounds, and the light hydrocarbon fractionator which fractionally distills the light hydrocarbon compounds. Thus, fractional distillation of the heavy hydrocarbon compounds and the light hydrocarbon compounds can be performed separately. Hence, it is unnecessary to heat the light hydrocarbon compounds in the light hydrocarbon fractionator more than needed, and the energy cost can be significantly reduced. Additionally in the light hydrocarbon fractionator, the hydrocarbon compounds equivalent to naphtha can be efficiently obtained.

The hydrocarbon compound distillation separation apparatus may further includes a light hydrocarbon separator for separating hydrocarbon compounds equivalent to naphtha from the light gas fraction.

In this case, the hydrocarbon compounds equivalent to naphtha can be separated from the light gas fraction, even if the light gas fraction includes the hydrocarbon compounds equivalent to naphtha.

In the hydrocarbon compound distillation separation apparatus, the light hydrocarbon separator may includes a reflux line which refluxes a part of the hydrocarbon compounds equivalent to naphtha to the light hydrocarbon fractionator.

The hydrocarbon compound distillation separation apparatus may further includes a mixing section for mixing the hydrocarbon compounds equivalent to naphtha, the first middle distillate, and the second middle distillate.

The hydrocarbon compounds equivalent to naphtha, the first middle distillate, and the second middle can be hydrotreated under the same conditions. Accordingly, it is possible to hydrotreat a mixture of the hydrocarbon compounds equivalent to naphtha, the first middle distillate, and the second middle distillate, obtained in the mixing section.

Advantageous Effects of Invention

According to the present invention, it is possible to provide a method for upgrading hydrocarbon compounds and a hydrocarbon compound distillation separation apparatus capable of efficiently recovering hydrocarbon compounds equivalent to naphtha from hydrocarbon compounds synthesized in the Fisher-Tropsch synthesis reaction, and reducing the energy cost for separating a naphtha fraction, a middle distillate, and a wax fraction from the hydrocarbon compounds synthesized in the Fisher-Tropsch synthesis reaction.

BRIEF DESCRIPTION OF THE DRAWINGS

FIG. 1 A schematic diagram showing the overall configuration of a hydrocarbon synthesizing system including a hydrocarbon compound distillation separation apparatus according to the embodiment of the present invention.

FIG. 2 An explanatory view showing the periphery of the hydrocarbon compound distillation separation apparatus according to the embodiment of the present invention.

FIG. 3 A flow chart showing the method for upgrading hydrocarbon compounds according to the embodiment of the present invention.

DESCRIPTION OF EMBODIMENTS

Hereinafter, a preferred embodiment of the present invention will be described with reference to the accompanying drawings.

First, with reference to FIG. 1, the overall configuration and process of a liquid fuel synthesizing system (hydrocarbon synthesis reaction system) including a hydrocarbon compound distillation separation apparatus of the present embodiment will be described.

As shown in FIG. 1, the liquid fuel synthesizing system (hydrocarbon synthesis reaction system) 1 according to the present embodiment is a plant facility which carries out the GTL process which converts a hydrocarbon feedstock, such as a natural gas, into liquid fuels. This liquid fuel synthesizing system 1 includes a synthesis gas production unit 3, an FT synthesis unit 5, and an upgrading unit 7.

The synthesis gas production unit 3 reforms a natural gas, which is a hydrocarbon feedstock, to produce a synthesis gas (a feedstock gas) including a carbon monoxide gas and a hydrogen gas.

The FT synthesis unit 5 synthesizes liquid hydrocarbon compounds from the produced synthesis gas (a feedstock gas) by the Fischer-Tropsch synthesis reaction.

The upgrading unit 7 hydrogenates and fractionally distills the liquid hydrocarbon compounds synthesized by the Fischer-Tropsch synthesis reaction to produce liquid fuel products (a naphtha, a kerosene, a gas oil, wax, and so on). Hereinafter, components of these respective units will be described.

The synthesis gas production unit 3 mainly includes a desulfurization reactor 10, a reformer 12, a waste heat boiler 14, gas-liquid separators 16 and 18, a $CO_2$ removal unit 20, and a hydrogen separator 26.

The desulfurization reactor 10 is composed of, for example, a hydrodesulfurizer, and removes sulfur components from a natural gas that is a feedstock.

The reformer 12 reforms the natural gas supplied from the desulfurization reactor 10 to produce a synthesis gas including a carbon monoxide gas (CO) and a hydrogen gas ($H_2$) as main components.

The waste heat boiler 14 recovers the waste heat of the synthesis gas produced in the reformer 12, and generates a high-pressure steam (about 260° C. to 300° C.).

The gas-liquid separator 16 separates the water heated by the heat exchange with the synthesis gas in the waste heat boiler 14 into a gas (high-pressure steam) and a liquid.

The gas-liquid separator 18 removes a condensed component from the synthesis gas cooled down in the waste heat boiler 14, and supplies a gas component to the $CO_2$ removal unit 20.

The $CO_2$ removal unit 20 has an absorption tower 22 and a regeneration tower 24. The absorption tower 22 allows an absorption solvent to absorb the carbon dioxide gas from the synthesis gas supplied from the gas-liquid separator 18. The regeneration tower 24 allows the absorption solvent including the carbon dioxide gas to strip the carbon dioxide gas and regenerates the absorption solvent.

The hydrogen separator 26 separates a part of the hydrogen gas included in the synthesis gas from which the carbon dioxide gas has been separated in the $CO_2$ removal unit 20.

The FT synthesis unit 5 mainly includes, for example, a bubble column reactor (a bubble column hydrocarbon synthesis reactor) 30, a gas-liquid separator 34, a separator 36, a gas-liquid separator 38, and a hydrocarbon compound distillation separation apparatus 100 of the present embodiment.

The bubble column reactor 30, which is an example of a reactor which synthesizes liquid hydrocarbon compounds from the synthesis gas, functions as a synthesis reactor which synthesizes liquid hydrocarbon compounds from the synthesis gas by the Fisher-Tropsch synthesis reaction. The bubble column reactor 30 includes, for example, a bubble column slurry bed type reactor containing a slurry inside a column type vessel. Liquid hydrocarbon compounds (product of the Fisher-Tropsch synthesis reaction) suspending solid catalyst particles are used as the slurry. The bubble column reactor 30 allows the carbon monoxide gas and the hydrogen gas contained in the synthesis gas produced in the above synthesis gas production unit 3 to react with each other to synthesize liquid hydrocarbon compounds.

The gas-liquid separator 34 separates the water circulated and heated through a heat transfer pipe 32 disposed in the bubble column reactor 30 into a steam (medium-pressure steam: a temperature of about 200° C.) and a liquid.

The separator 36 separates the slurry discharged from the bubble column reactor 30 into the catalyst particles and the liquid hydrocarbon compounds.

The gas-liquid separator 38 is connected to the top of the bubble column reactor 30 to cool down the unreacted synthesis gas and gaseous by-products including the light hydrocarbon compounds.

The hydrocarbon compound distillation separation apparatus 100 mainly includes a heavy hydrocarbon fractionator 110, a light hydrocarbon fractionator (debutanizer as a typical example) 120, and a light hydrocarbon separator (reflux drum) 132. The heavy hydrocarbon fractionator 110 distills the heavy hydrocarbon compounds supplied from the bubble column reactor 30 via the separator 36. The light hydrocarbon fractionator 120 distills the light hydrocarbon compounds supplied from the bubble column reactor 30 via the gas-liquid separator 38. The light hydrocarbon separator 132 separates hydrocarbons equivalent to naphtha from a light gas fraction fractionally distilled in the light hydrocarbon fractionator 120.

The upgrading unit 7 includes a hydrocracking reactor 50, a hydrotreating reactor 52, gas-liquid separators 56 and 58, a fractionator 70, and a naphtha stabilizer 72.

The hydrocracking reactor 50 is connected to the heavy hydrocarbon fractionator 110 of the hydrocarbon compound distillation separation apparatus 100, and a gas-liquid separator 56 is provided at the downstream of the hydrocracking reactor 50.

The hydrotreating reactor 52 is connected to the heavy hydrocarbon fractionator 110, the light hydrocarbon fractionator 120, and the light hydrocarbon separator 132 of the FT synthesis hydrocarbon distillation separation apparatus 100. And a gas-liquid separator 58 is provided at the downstream of the hydrotreating reactor 52.

The fractionator 70 fractionally distills the liquid hydrocarbon compounds supplied from the gas-liquid separators 56 and 58 according to boiling points.

The naphtha stabilizer 72 rectifies hydrocarbon compounds equivalent to naphtha to discharge a light component as an off-gas and separate and recover a heavy component as a naphtha product.

Next, a process of synthesizing liquid fuels from a natural gas (GTL process) by the liquid fuel synthesizing system 1 configured as above will be described.

An external natural gas supply source (not shown), such as a natural gas field or a natural gas plant supplies a natural gas (containing $CH_4$ as a main component) to the liquid fuel synthesizing system 1 as a hydrocarbon feedstock. The above synthesis gas production unit 3 reforms the natural gas to produce synthesis gas (mixed gas including a carbon monoxide gas and a hydrogen gas as main components).

First, the natural gas supplied from the external natural gas source is supplied to the desulfurization reactor 10 along with the hydrogen gas separated by the hydrogen separator 26. The desulfurization reactor 10 allows conversion of sulfur components included in the supplied natural gas to a hydrogen sulfide by the supplied hydrogen gas and a hydrodesulfurization catalyst, and allows adsorption and removal of the generated hydrogen sulfide by, for example, ZnO.

The desulfurized natural gas is supplied to the reformer 12 after the carbon dioxide ($CO_2$) gas supplied from a carbon-dioxide supply source (not shown) and the steam generated in the waste heat boiler 14 are mixed thereto. The reformer 12 reforms the natural gas by the steam and carbon-dioxide-gas reforming method using the carbon dioxide gas and the steam, and produces a high-temperature synthesis gas including a carbon monoxide gas and a hydrogen gas as main components.

The high-temperature synthesis gas (for example, 900° C., 2.0 MPaG) produced in the reformer 12 in this way is supplied to the waste heat boiler 14, and is cooled down (for example, to 350° C.) by the heat exchange with the water which circulates through the waste heat boiler 14. Thereby, the waste heat of the synthesis gas is recovered via the water which circulates through the waste heat boiler 14.

The synthesis gas cooled down in the waste heat boiler 14 is supplied to the absorption tower 22 of the $CO_2$ removal unit 20, or the bubble column reactor 30, after condensed components are separated and removed in the gas-liquid separator 18. The absorption solvent within the absorption tower 22 absorbs a carbon dioxide gas included in the synthesis gas supplied to the absorption tower 22. The absorption solvent which has absorbed the carbon dioxide gas in the absorption tower 22 is brought to the regeneration tower 24, where the carbon dioxide gas is stripped from the absorption solvent. In addition, the carbon dioxide gas stripped in the regeneration tower 24 is brought to the reformer 12 from the regeneration tower 24, and is reused for the above stated reforming reaction.

The synthesis gas produced in the synthesis gas production unit 3 in this way is supplied to the bubble column reactor 30 of the above FT synthesis unit 5. At this time, the composition ratio of the synthesis gas supplied to the bubble column reactor 30 is adjusted to a composition ratio suitable for the Fisher-Tropsch synthesis reaction (for example, $H_2$:CO=2:1 (molar ratio)).

Additionally, the hydrogen separator 26 separates the hydrogen gas included in the synthesis gas, by the adsorption and desorption utilizing a pressure difference (hydrogen PSA). The separated hydrogen gas is continuously supplied from a gas holder (not shown), via a compressor (not shown) to various hydrogen-utilizing reaction devices (for example, the desulfurization reactor 10, the hydrocracking reactor 50, the hydrotreating reactor 52) which perform reactions utilizing hydrogen within the liquid fuel synthesizing system 1.

Next, the above FT synthesis unit 5 synthesizes liquid hydrocarbon compounds by the Fisher-Tropsch synthesis reaction from the synthesis gas produced in the above synthesis gas production unit 3.

The synthesis gas produced in the above synthesis gas production unit 3 flows into the bottom of the bubble column reactor 30, and rises through the slurry contained in the bubble column reactor 30. At this time, within the bubble column reactor 30, the carbon monoxide and the hydrogen gas which are included in the synthesis gas react with each other by the aforementioned Fisher-Tropsch synthesis reaction, thereby hydrocarbon compounds are synthesized.

A liquid component of the hydrocarbon compounds (heavy hydrocarbon compounds) synthesized in the bubble column reactor 30 is introduced into the separator 36 along with catalyst particles as a slurry.

The separator 36 separates the slurry into a solid component, such as catalyst particles, and a liquid component including the heavy hydrocarbon compounds. A part of the separated solid component, such as the catalyst particles, is returned to the bubble column reactor 30. The separated heavy hydrocarbon compounds are supplied to the heavy hydrocarbon fractionator 110 of the hydrocarbon compound distillation separation apparatus 100.

Additionally, by-products of the Fisher-Tropsch synthesis reaction are discharged from the top of the bubble column reactor 30. The by-products include an unreacted synthesis gas and the light hydrocarbon compounds generated in the bubble column reactor 30, and separated into a liquid component and gaseous by-products in the gas-liquid separator 38.

The liquid component separated in the gas-liquid separator 38 is supplied to the light hydrocarbon fractionator 120 of the hydrocarbon compound distillation separation apparatus 100.

A part of the gaseous by-products separated in the gas-liquid separator 38 are introduced again to the bottom of the bubble column reactor 30 and are reused for the Fisher-Tropsch synthesis reaction. The rest of the gaseous by-products is discharged as an off-gas, and is used as a fuel gas, and a fuel equivalent to LPG (Liquefied Petroleum Gas) is recovered, or is reused as a feedstock of the reformer 12 of the synthesis gas production unit 3.

Next, the heavy hydrocarbon fractionator 110 heats and fractionally distills the heavy hydrocarbon compounds supplied from the bubble column reactor 30 via the separator 36 according to boiling points. In this way, the heavy hydrocarbon fractionator 110 fractionally distills the heavy hydrocarbon compounds into a gas fraction, a first middle distillate (hydrocarbon compounds of which the boiling point is about 360° C. or lower), and a wax fraction (hydrocarbon compounds of which the boiling point exceeds about 360° C.).

Additionally, the light hydrocarbon fractionator 120 heats and fractionally distills the light hydrocarbon compounds supplied from the bubble column reactor 30 via the gas-liquid separator 38 into a light gas fraction (hydrocarbon compounds of approximately $C_4$ or less) and a second middle distillate (hydrocarbon compounds of approximately $C_5$ or more). The light gas fraction drawn from the light hydrocarbon fractionator 120 is brought to the light hydrocarbon separator 132 where hydrocarbon compounds equivalent to naphtha are separated.

Then, the wax fraction (hydrocarbon compounds of which the boiling point exceeds about 360° C.) drawn from the bottom of the heavy hydrocarbon fractionator 110 is brought to the hydrocracking reactor 50.

The first middle distillate drawn from a middle of the heavy hydrocarbon fractionator 110 is mixed with the second middle distillate drawn from the light hydrocarbon fractionator 120, and the hydrocarbon compounds equivalent to naphtha drawn from the light hydrocarbon separator 132, and is brought to the hydrotreating reactor 52.

The hydrocracking reactor 50 hydrocracks a wax fraction with a large number of carbon atoms (approximately $C_{21}$ or more) by using the hydrogen gas supplied from the above hydrogen separator 26, to reduce the number of carbon atoms to 20 or less. In this hydrocracking reaction, hydrocarbon compounds with a small number of carbon atoms and with low molecular weight are generated by cleaving C—C bonds of hydrocarbon compounds with a large number of carbon atoms, using a catalyst and heat. A product including the liquid hydrocarbon compounds hydrocracked in this hydrocracking reactor 50 is separated into a gas component and liquid hydrocarbon compounds in the gas-liquid separator 56. The liquid hydrocarbon compounds are brought to the fractionator 70, and the gas component (including hydrogen gas) is brought to the hydrotreating reactor 52.

The hydrotreating reactor 52 hydrotreats a middle distillate with a medium number of carbon atoms (approximately $C_{11}$ to $C_{20}$), and hydrocarbon compounds equivalent to naphtha (approximately $C_5$ to $C_{10}$), by using the hydrogen gas supplied from the hydrogen separator 26 via the hydrocracking reactor 50. This hydrotreating reaction is composed mainly of a reaction where olefins and oxygen-containing compounds, such as alcohols, which are generated as by-products in the Fisher-Tropsch synthesis reaction, are respectively hydrogenated and hydrodeoxygenated into saturated hydrocarbon compounds, and a reaction where branched saturated hydrocarbon compounds (isoparaffins) are produced by isomerization of normal paraffins that are main component of the hydrocarbon compounds. A product including the hydrotreated hydrocarbon compounds is separated into a gas component and liquid hydrocarbon compounds in the gas-liquid separator 58. The separated liquid hydrocarbon compounds are brought to the fractionator 70, and the separated gas component (including a hydrogen gas) is reused for the above hydrogenation reactions.

Next, the fractionator 70 fractionally distills the liquid hydrocarbon compounds, which are supplied from the hydrocracking reactor 50 and the hydrotreating reactor 52, into hydrocarbon compounds of $C_5$ or less (the boiling point of which is lower than about 150° C.), kerosene (the boiling point of which is about 150 to 250° C.), a gas oil (the boiling point of which is about 250 to 360° C.), and an uncracked wax fraction (the boiling point of which exceeds 360° C.). The uncracked wax fraction is obtained from the bottom of the fractionator 70, and is recycled to the upstream of the hydrocracking reactor 50. A kerosene and a gas oil are drawn from the middle of the fractionator 70. Meanwhile, hydrocarbon compounds of $C_{10}$ or less are drawn as a gas from the top of the fractionator 70, and is supplied to the naphtha stabilizer 72.

Moreover, the naphtha stabilizer 72 distills the hydrocarbon compounds of $C_{10}$ or less, which have been fractionally distilled in the above fractionator 70, and thereby, obtains a naphtha ($C_5$ to $C_{10}$) as a product. Accordingly, a high-purity naphtha is drawn from the bottom of the naphtha stabilizer 72. Meanwhile, an off-gas other than the target products, including hydrocarbon compounds of which a number of carbon atoms is less than a predetermined number as a main component, is discharged from the top of the naphtha stabilizer 72. This off-gas is used as a fuel gas, and a fuel equivalent to LPG is recovered from the off-gas.

The process of the liquid fuel synthesizing system 1 (GTL process) has been described hitherto. By the GTL process concerned, a natural gas is converted into liquid fuels, such as a high-purity naphtha ($C_5$ to $C_{10}$: raw gasoline), a kerosene ($C_{11}$ to $C_{15}$), and a gas oil ($C_{16}$ to $C_{20}$).

Next, the configuration of the periphery of the hydrocarbon compound distillation separation apparatus 100 that is the present embodiment will be described in detail with reference to FIG. 2.

This hydrocarbon compound distillation separation apparatus 100 mainly includes the heavy hydrocarbon fractionator 110, the light hydrocarbon fractionator 120, and the light hydrocarbon separator 132 as mentioned above.

A first heater 119 which heats the supplied heavy hydrocarbon compounds is provided between the separator 36 and the heavy hydrocarbon fractionator 110. Additionally, a gas fraction discharge line 111 is connected to a top of the heavy hydrocarbon fractionator 110, a first middle distillate discharge line 112 is connected to the middle thereof, a wax fraction discharge line 113 is connected to a bottom thereof, and a supply line 114 is connected to a lower part thereof.

The gas component is discharged from the top of the heavy hydrocarbon fractionator 110 via the gas fraction discharge line 111. The first middle distillate is discharged from a middle of the heavy hydrocarbon fractionator 110 via the first middle distillate discharge line 112. The wax fraction is discharged from the bottom of the heavy hydrocarbon fractionator 110 via the wax fraction discharge line 113. A stripping steam (for example, about 150° C.) is supplied to a lower part of the heavy hydrocarbon fractionator 110 via the supply line 114.

Here, the gas component discharge line 111 is provided with a heat exchanger 115 which cools the gas component, and the cooled gas component is brought to a separator (reflux drum) 116. In this separator 116, the cooled gas component is separated into a condensate including liquid hydrocarbon compounds and water, and an off-gas. Then, the liquid hydrocarbon compounds are returned to the heavy hydrocarbon fractionator 110, and water and the off-gas are respectively discharged to the outside.

Additionally, the first middle distillate discharge line 112 is connected to the hydrotreating reactor 52 via a side stripper 117 and a mixing line (mixing section) 105.

Moreover, the wax fraction discharge line 113 is connected to the hydrocracking reactor 50.

A light gas fraction discharge line 121 is connected to a top of the light hydrocarbon fractionator 120, and a second middle distillate discharge line 122 is connected to a bottom thereof. A light gas fraction discharged from the top of the column is discharged via the light gas fraction discharge line 121, and a second middle distillate discharged from the bottom of the light hydrocarbon fractionator 120 is discharged via the second middle distillate discharge line 122.

The second middle distillate discharge line 122 is connected to the hydrotreating reactor 52 via the mixing line 105 and provided with a recycle line 128. A part of the second middle distillate is recycled via the recycle line 128 to the light hydrocarbon fractionator 120. In addition, this recycle line 128 is provided with a second heater 129 which heats the second middle distillate. Additionally, the light gas component discharge line 121 is connected to the light hydrocarbon separator 132 through a heat exchanger 131.

Here, in the light hydrocarbon fractionator 120, the light hydrocarbon compounds are heated using the high-pressure steam (about 260° C. to 300° C.) obtained by the heat exchange with the synthesis gas in the waste heat boiler 14.

The light hydrocarbon separator 132 separates the light gas component, which has been cooled down via the heat exchanger 131, into hydrocarbon compounds equivalent to naphtha (naphtha fraction), water, and an off-gas. A part of the separated hydrocarbon compounds equivalent to naphtha is refluxed to the light hydrocarbon fractionator 120 via a reflux line 133, and the rest is mixed with the first middle distillate and the second middle distillate via the mixing line 105, and is brought to the hydrotreating reactor 52.

Next, a method for upgrading hydrocarbon compounds of the present embodiment using the hydrocarbon compound distillation separation apparatus 100 stated above will be described with reference to FIGS. 2 and 3.

First, hydrocarbon compounds are synthesized in the bubble column reactor (synthesis reactor) 30 (hydrocarbon compound synthesizing step S1).

Heavy hydrocarbon compounds discharged as a liquid from the bubble column reactor 30 are brought to the separator 36 as a slurry mixed with a catalyst. Then, the catalyst and the heavy hydrocarbon compounds are separated in the separator 36 (heavy hydrocarbon compound separating step S2).

The separated heavy hydrocarbon compounds are heated in the first heater 119 and are brought to the heavy hydrocarbon fractionator 110. In this heavy hydrocarbon fractionator 110, the heavy hydrocarbon compounds are fractionally distilled into a gas fraction, a first middle distillate (hydrocarbon compounds of which the boiling point is about 360° C. or lower), and a wax fraction (hydrocarbon compounds of which the boiling point exceeds about 360° C.) (heavy hydrocarbon compound fractionally-distilling step S3). Here, in the heavy hydrocarbon compound fractionally-distilling step S3, the pressure of the gas fraction at the top of the heavy hydrocarbon fractionator 110 is set to 130 to 170 kPa, and the temperature at the outlet of the heat exchanger 115 which cools down this gas fraction is set to 20 to 50° C.

The first middle distillate fractionally distilled in the heavy hydrocarbon fractionator 110 is brought to the hydrotreating reactor 52, and the wax fraction is brought to the hydrocracking reactor 50.

Meanwhile, mixture of the light hydrocarbon compounds, moisture and the unreacted synthesis gas is brought to the gas-liquid separator 38, and a condensed liquid component (light hydrocarbon compounds) is separated in the gas-liquid separator 38 (light hydrocarbon compound separating step S4).

The light hydrocarbon compounds separated in the gas-liquid separator 38 are brought to the light hydrocarbon fractionator 120. In this light hydrocarbon fractionator 120, the light hydrocarbon compounds are fractionally distilled into a light gas fraction (hydrocarbon compounds of approximately $C_4$ or less) and a second middle distillate (hydrocarbon compounds of approximately $C_5$ or more) (light hydrocarbon compound fractionally-distilling step S5). Here, in the light hydrocarbon compound fractionally-distilling step S5, the temperature of the light gas fraction at the top of the light hydrocarbon fractionator 120 is set to be 100 to 120° C. Moreover, the temperature of the second middle distillate at the bottom of the light hydrocarbon fractionator 120 is set to 250 to 270° C.

The light gas fraction fractionally distilled in the light hydrocarbon fractionator 120 is cooled down by the heat exchanger 131 (light gas cooling step S6), and condensed hydrocarbon compounds equivalent to naphtha are separated in the light hydrocarbon separator 132 (naphtha fraction separating step S7). Here, the temperature of the light gas fraction at the outlet of the heat exchanger 131 which cools down the light gas fraction is set to 10 to 50° C. Additionally, the pressure of the light gas fraction inside of the light hydrocarbon separator 132 is set to 200 to 600 kPa.

A part of the hydrocarbon compounds equivalent to naphtha separated in the naphtha fraction separating step S7 is refluxed to the light hydrocarbon fractionator 120 (reflux step S11).

The remaining hydrocarbon compounds equivalent to naphtha which have not been provided for the reflux step S11, and the second middle distillate fractionally distilled in the light hydrocarbon fractionator 120 are mixed with the first middle distillate fractionally distilled in the heavy hydrocarbon fractionator 110 (mixing step S8), and are brought to the hydrotreating reactor 52.

Under such conditions, the ratio of the hydrocarbon compounds equivalent to naphtha mixed with the first middle distillate and the second middle distillate without being provided for the reflux step S11 is set to 10 to 25 mol % of the total amount of supply of the hydrocarbon compounds equivalent to naphtha to the light hydrocarbon fractionator 120.

Then, the hydrocarbon compounds equivalent to naphtha, the first middle distillate, and the second middle distillate are subjected to the aforementioned hydrotreating in the hydrotreating reactor 52 (hydrotreating step S9).

Meanwhile, the wax fraction brought to the hydrocracking reactor 50 is subjected to the aforementioned hydrocracking in the hydrocracking reactor 50 (hydrocracking step S10).

The hydrocarbon compounds which have been subjected to the hydrotreating or hydrocracking in this way are fractionally distilled in the fractionator 70, and are processed in the naphtha stabilizer 72 to obtain liquid fuels and the other products, such as a naphtha, a kerosene, a gas oil, and a wax.

According to the hydrocarbon compound distillation separation apparatus 100 of the present embodiment described above, the heavy hydrocarbon fractionator 110 which fractionally distills the heavy hydrocarbon compounds into the first middle distillate and the wax fraction, and the light hydrocarbon fractionator 120 which fractionally distills the light hydrocarbon compounds into the light gas fraction and the second middle distillate are separately provided. That is, according to the method for upgrading hydrocarbon compounds of the present embodiment, fractional distillation of the heavy hydrocarbon compounds into the first middle distillate and the wax fraction, and fractional distillation of the light hydrocarbon compounds into the light gas fraction and the second middle distillate are separately performed. Thus, it is possible to reduce the energy for heating required for fractional distillation of the light hydrocarbon compounds, compared with a case where the heavy hydrocarbon compounds discharged as a liquid from the bubble column reactor 30 and the light hydrocarbon compounds discharged as a gas from the bubble column reactor 30 are mixed, and are fractionally distilled into the respective fractions in a single fractionator. That is, in the case where the light and heavy hydrocarbon compounds are mixed and the resulting mixture is fractionally distilled in a single fractionator to obtain a naphtha fraction from the top of the fractionator, a middle distillate from the middle thereof, and a wax fraction from the bottom thereof, it is necessary to evaporate substantially all of the light hydrocarbon compounds including the naphtha fraction and the second middle distillate.

On the other hand, in the light hydrocarbon fractionator 120 of the present embodiment, it is necessary to evaporate only the naphtha fraction and it is not necessary to evaporate the second middle distillate because the second middle distillate is drawn from the bottom of the fractionator. Additionally, when the light and heavy hydrocarbon compounds are mixed and the resulting mixture is fractionally distilled in a single fractionator, since the naphtha fraction and the second middle distillate are heated along with the heavy hydrocarbon compounds, the light hydrocarbon compounds are heated to the temperature higher than that essentially required for fractional distillation thereof.

According to the present embodiment, on the other hand, the naphtha fraction and the second middle distillate are separately fractionally distilled. Thus, the naphtha fraction and the second middle distillates can be heated to a proper temperature for fractional distillation thereof.

As a result, according to the hydrocarbon compounds separation distillation apparatus 100 and the method for upgrading the hydrocarbon compounds of the present embodiment, it is possible to reduce the energy required for distillation of the hydrocarbon compounds.

Additionally in the light hydrocarbon fractionator 120, the light hydrocarbon compounds including a lot of hydrocarbon compounds equivalent to naphtha are fractionally distilled into the light gas fraction and the second middle distillate. Thus, the hydrocarbon compounds equivalent to naphtha can be efficiently recovered.

Additionally, the light hydrocarbon separator 132 which separates the hydrocarbon compounds equivalent to naphtha from the light gas fraction is provided. Thus, even if the conditions are set so that the content of hydrocarbon compounds included in the light gas fraction becomes large in the light hydrocarbon fractionator 120, the hydrocarbon compounds equivalent to naphtha can be efficiently recovered.

In the present embodiment, the temperature of the light gas fraction at the top of the light hydrocarbon fractionator 120 is set to be 100 to 120° C. Accordingly, water can be prevented from condensing in the light hydrocarbon fractionator 120. Hence, it is possible to stably operate the light hydrocarbon fractionator 120.

Additionally, the temperature of the second middle distillate at the bottom of the column is set to 250 to 270° C. Accordingly, it is possible to utilize the high-pressure steam (260 to 300° C.), which is obtained by the heat exchange with the synthesis gas in the waste heat boiler 14, for heating the light hydrocarbon compounds.

Moreover, the pressure of the light gas fraction inside of the light hydrocarbon separator 132 is set to 200 to 600 kPa. Accordingly, water can be prevented from condensing in the light hydrocarbon fractionator 120.

Additionally, the hydrocarbon compounds equivalent to naphtha, the first middle distillate, and the second middle distillate are mixed in the mixing line 105 and the obtained mixture is subjected to hydrotreating in the hydrotreating reactor 52. Accordingly, the hydrocarbon compounds equivalent to naphtha, the first middle distillate, and the second middle distillate, can be hydrotreated simultaneously, so that the hydrotreating can be efficiently performed.

Although the embodiment of the present invention has been described hitherto in detail with reference to the drawings, concrete configurations are not limited to the embodiment, and the invention also includes design changes which do not depart from the spirit of the present invention.

For example, although the configuration in which the hydrocarbon compounds equivalent to naphtha, which have been separated in the light hydrocarbon separator, the first middle distillate, and the second middle distillate are mixed together and are subjected to hydrotreating has been described, the invention is not limited to this, and the hydrocarbon compounds equivalent to naphtha may be separately subjected to hydrotreating.

Additionally, the configuration of the synthesis gas production unit 3, the FT synthesis unit 5, and the upgrading unit 7 are not limited to that described in the present embodiment, and any arbitrary configuration may be adopted so long as the fractional distillations of the light hydrocarbon compounds and the heavy hydrocarbon compounds synthesized in the synthesis reactor are separately performed.

Moreover, although description has been made taking the slurry bed type synthesis reactor as an example, the invention is not limited to the configuration of the synthesis reactor, and for example, a fixed bed type synthesis reactor may be adopted.

EXAMPLES

The results of a confirmation experiments conducted to confirm the effects of the present invention will be described below. As a comparative example, light hydrocarbon compounds discharged as a gas from a FT synthesis reactor and heavy hydrocarbon compounds discharged as a liquid from the FT synthesis reactor were mixed together, and were then fractionally distilled in a fractionator. In addition, the pressure of a separator connected to the fractionator was set to 500 kPa, and the condensation temperature of the gas from the top of the fractionator 110 (light gas fraction) at the outlet of the heat exchanger was set to 40° C.

As examples, the heavy hydrocarbon compounds discharged as a liquid from the FT synthesis reactor were fractionally distilled in the heavy hydrocarbon fractionator, and the light hydrocarbon compounds discharged as a gas from the FT synthesis reactor were fractionally distilled in the light hydrocarbon fractionator 120. In addition, in Example 1, the pressure inside of the separator (light hydrocarbon separator 132) connected to the light hydrocarbon fractionator 120 was set to 300 kPa, the temperature at the top the light hydrocarbon fractionator 120 was set to 105° C., the temperature at the bottom of the light hydrocarbon fractionator 120 was set to 250° C., and the condensation temperature of the gas from the top of the light hydrocarbon fractionator 120 at the outlet of the heat exchanger 131 was set to 40° C. Additionally, the pressure in the top of the heavy hydrocarbon fractionator 110 was set to 500 kPa, and the condensation temperature of the gas from the top of the heavy hydrocarbon fractionator 110 at the outlet of the heat exchanger 115 was set to 40° C. In Example 2, the pressure inside of the separator (light hydrocarbon separator 132) connected to the light hydrocarbon fractionator 120 was set to 300 kPa, the temperature at the top of the light hydrocarbon fractionator 120 was set to 105° C., the temperature at the bottom of the light hydrocarbon fractionator 120 was set to 250° C., and the condensation temperature of the gas from the top of the light hydrocarbon fractionator 120 at the outlet of the heat exchanger 131 was set to 40° C. Additionally, the pressure in the top of the heavy hydrocarbon fractionator 110 was set to 500 kPa, and the condensation temperature of the gas from the top of the heavy hydrocarbon fractionator 110 at the outlet of the heat exchanger 115 was set to 25° C.

In the comparative example and the examples, the heat duties required for distillation in the hydrocarbon compound distillation separation apparatus, and the loss rates of the hydrocarbon compounds equivalent to naphtha (hydrocarbon compounds of $C_5$ or more, and with a boiling point of about 150° C. or lower) were evaluated. The loss rate (mass %) of the hydrocarbon compounds equivalent to naphtha is expressed by the ratio of the mass discharge rate of the hydrocarbon compounds equivalent to naphtha included in the off-gas which is separated in and discharged from each separator, to the mass feed rate of the hydrocarbon compounds equivalent to naphtha included in the light and heavy hydrocarbon compounds which are supplied to the hydrocarbon compound distillation separation apparatus.

The evaluation results are shown in Table 1.

TABLE 1

| | Heat Duty*1 | Loss Rate of Hydrocarbons Equivalent to Naphtha (mass %) |
|---|---|---|
| Example 1 | 0.59 | 5.2 |
| Example 2 | 0.59 | 4.7 |
| Comparative Example | 1 | 13.6 |

*1Comparison when the heat duty required for heating the fractionator in the comparative example is defined as 1

When the heat duty in the comparative example was defined as 1, the heat duties required for the distillation in Examples 1 and 2 became 0.59 and 0.59, respectively.

Additionally, in the comparative example, the loss rate of the hydrocarbon compounds equivalent to naphtha was 13.6 mass %. In contrast, in Example 1, the loss rate of the hydrocarbon compounds equivalent to naphtha was 5.2 mass %, and in Example 2, the loss rate of the hydrocarbon compounds equivalent to naphtha was 4.7 mass %.

As a result, according to the examples, it was confirmed that the heat duty required for distillation can be reduced, and the hydrocarbon compounds equivalent to naphtha can be efficiently recovered.

INDUSTRIAL APPLICABILITY

According to the method for upgrading hydrocarbon compounds and hydrocarbon compounds distillation separation apparatus of the present invention, the hydrocarbon compounds equivalent to naphtha can be efficiently recovered from the hydrocarbon compounds synthesized in the Fisher-Tropsch synthesis reactor, and the energy cost when the naphtha fraction, the middle distillate, and the wax fraction are separated can be reduced.

REFERENCE SIGNS LIST

30: BUBBLE COLUMN REACTOR (FT SYNTHESIS REACTOR)
100: HYDROCARBON COMPOUND DISTILLATION SEPARATION APPARATUS
105: MIXING LINE (MIXING SECTION)
110: HEAVY HYDROCARBON FRACTIONATOR
120: LIGHT HYDROCARBON FRACTIONATOR
132: LIGHT HYDROCARBON SEPARATOR (REFLUX DRUM)

The invention claimed is:

1. A hydrocarbon distillation separation apparatus for fractionally distilling hydrocarbon compounds discharged from a synthesis reactor, the apparatus comprising:

the synthesis reactor configured to synthesize hydrocarbon compounds using a Fisher-Tropsch synthesis reactions;

a heavy hydrocarbon fractionator communicating with a middle part of a body of the synthesis reactor and configured to fractionally distil liquid heavy hydrocarbon compounds of the hydrocarbon compounds discharged from the synthesis reactor into a first middle distillate and a wax fraction;

a first line connecting the middle part of the body of the synthesis reactor with the heavy hydrocarbon fractionator and configured such that the liquid heavy hydrocarbon compounds are supplied from the synthesis reactor to the heavy hydrocarbon fractionator there through;

a first middle distillate discharge line connected to a middle part of a body of the heavy hydrocarbon fractionator and configured such that the first middle distillate is discharged from the heavy hydrocarbon fractionator there through;

a light hydrocarbon fractionator communicating with a top of the body of the synthesis reactor and configured to fractionally distil gaseous light hydrocarbon compounds of the hydrocarbon compounds discharged from the synthesis reactor into a second middle distillate and a light gas fraction;

a second line connecting the top of the body of the synthesis reactor with the light hydrocarbon fractionator and configured such that the gaseous light hydrocarbon compounds are supplied from the synthesis reactor to the light hydrocarbon fractionator there through;

a second middle distillate discharge line connected to a bottom part of a body of the light hydrocarbon fractionator and configured such that the second middle distillate is discharged from the light hydrocarbon fractionator there through;

a light gas fraction discharge line connected to a top of the body of the light hydrocarbon fractionator and configured such that the light gas fraction is discharged from the light hydrocarbon fractionator there through;

a light hydrocarbon separator provided to the light gas fraction discharge line and configured to separate hydrocarbon compounds equivalent to naphtha from the light gas fraction discharged from the light hydrocarbon fractionator;

a mixing section connected with the first and second middle distillate discharge lines and the light gas fraction discharge line, located downstream of both the heavy hydrocarbon fractionator and the light hydrocarbon fractionator, and configured to mix the first middle distillate discharged from the heavy hydrocarbon fractionator, the second middle distillate discharged from the light hydrocarbon fractionator, and the hydrocarbon compounds equivalent to naphtha separated from the light gas fraction by the light hydrocarbon separator, and to obtain a mixture of them, and a hydrotreating reactor connected with the mixing section and configured to hydrotreat the mixture supplied from the mixing section.

2. The hydrocarbon distillation separation apparatus according to claim 1, further comprising a reflux line installed between the light hydrocarbon separator and the light hydrocarbon fractionator and through which a part of the hydrocarbon compounds equivalent to naphtha is refluxed therebetween.

* * * * *